US007128434B1

(12) United States Patent
Nally et al.

(10) Patent No.: US 7,128,434 B1
(45) Date of Patent: Oct. 31, 2006

(54) LIGHTED HEADGEAR WITH MOTION ACTIVATED SWITCH

(75) Inventors: Michael Nally, Ridgewood, NJ (US); Penny Lasater, Morristown, NJ (US)

(73) Assignee: Sportcraft, Ltd., Mt. Olive, NJ (US)

( * ) Notice: Subject to any disclaimer, the term of this patent is extended or adjusted under 35 U.S.C. 154(b) by 39 days.

(21) Appl. No.: 10/628,864

(22) Filed: Jul. 28, 2003

(51) Int. Cl.
*F21L 15/14* (2006.01)

(52) U.S. Cl. ..... 362/105; 362/103; 362/106

(58) Field of Classification Search ..... 362/106, 362/800, 103, 105
See application file for complete search history.

(56) References Cited

U.S. PATENT DOCUMENTS

| | | | | | |
|---|---|---|---|---|---|
| 3,963,917 | A | * | 6/1976 | Romano | 362/35 |
| 4,231,079 | A | | 10/1980 | Heminover | 362/106 |
| 4,400,591 | A | | 8/1983 | Jennings et al. | 179/156 |
| 4,648,131 | A | | 3/1987 | Kawaguchi et al. | 455/606 |
| 4,782,536 | A | | 11/1988 | Stricklin et al. | 2/414 |
| 4,817,212 | A | | 4/1989 | Benoit | 2/209 |
| 4,891,736 | A | | 1/1990 | Gouda | 362/105 |
| 4,901,211 | A | | 2/1990 | Shen | 362/106 |
| 4,945,458 | A | | 7/1990 | Batts et al. | 362/106 |
| 4,956,752 | A | | 9/1990 | Foglietti | 362/72 |
| 5,147,129 | A | | 9/1992 | Ku | 362/106 |
| 5,281,960 | A | | 1/1994 | Dwyer, III | 345/31 |
| 5,327,587 | A | | 7/1994 | Hurwitz | 2/422 |
| 5,353,008 | A | | 10/1994 | Eikenberry et al. | 340/479 |
| 5,357,409 | A | | 10/1994 | Glatt | 362/105 |
| 5,380,001 | A | * | 1/1995 | Socci et al. | 473/458 |
| 5,416,675 | A | | 5/1995 | DeBeaux | 362/106 |
| 5,544,027 | A | | 8/1996 | Orsano | 362/105 |
| 5,564,128 | A | | 10/1996 | Richardson | 2/422 |
| 5,570,946 | A | | 11/1996 | Chien | 362/84 |
| 5,680,718 | A | | 10/1997 | Ratcliffe et al. | 40/329 |
| 5,743,621 | A | | 4/1998 | Mantha et al. | 362/105 |
| 5,758,947 | A | | 6/1998 | Glatt | 362/105 |
| 5,784,724 | A | | 7/1998 | Liang | 2/424 |
| 5,803,574 | A | | 9/1998 | Szaniszlo | 362/32 |
| 5,810,467 | A | | 9/1998 | Hurwitz | 362/106 |
| 5,845,987 | A | | 12/1998 | Painter | 362/206 |
| 5,871,271 | A | * | 2/1999 | Chien | 362/106 |
| 5,931,559 | A | | 8/1999 | Pfaeffle | 362/106 |
| 5,952,913 | A | | 9/1999 | Cioletti et al. | 340/309.15 |
| 6,007,213 | A | | 12/1999 | Baumgartner | 362/106 |
| 6,159,324 | A | | 12/2000 | Watters et al. | 156/242 |
| 6,213,616 | B1 | | 4/2001 | Chien | 362/84 |
| 6,244,721 | B1 | | 6/2001 | Rodriguez et al. | 362/106 |
| 6,270,834 | B1 | | 8/2001 | Burrows | 427/66 |
| 6,271,631 | B1 | | 8/2001 | Burrows | 315/169.3 |
| 6,283,604 | B1 | | 9/2001 | Liao | 362/84 |

(Continued)

*Primary Examiner*—Sandra O'Shea
*Assistant Examiner*—Anabel Ton
(74) *Attorney, Agent, or Firm*—Fellers, Snider, Blankenship, Bailey & Tippens, P.C.

(57) ABSTRACT

A lighted helmet having a protective shell having: an outside surface, a plurality of lamps which emit light from the outside surface; a power supply, typically a battery; and a motion detecting switch in communication with the power supply and the plurality of lamps. When the helmet is worn by a user, even small movements of the head produce forces, which in turn, trigger the motion detecting switch. Upon triggering of the motion detecting switch, the lamps are illuminated for a predetermined period of time. Upon expiration of the time period, subsequent motion will retrigger the switch, once again activating the lamps. The process continues until the helmet is placed in a stationary position, at which time the lamps are extinguished upon expiration of the then active time period.

8 Claims, 6 Drawing Sheets

U.S. PATENT DOCUMENTS

| | | | | |
|---|---|---|---|---|
| 6,292,952 | B1 | 9/2001 | Watters et al. | 2/411 |
| 6,309,764 | B1 | 10/2001 | Burrows | 428/690 |
| 6,325,521 | B1 * | 12/2001 | Gregg et al. | 362/106 |
| 6,348,859 | B1 * | 2/2002 | Baker | 340/479 |
| 6,406,168 | B1 | 6/2002 | Whiting | 362/473 |
| 2002/0145865 | A1 | 10/2002 | Gregg | 362/106 |

* cited by examiner

LIGHTED HEADGEAR WITH MOTION ACTIVATED SWITCH

1. Field of the Invention

This invention relates generally to illuminated safety helmets. More particularly, but not by way of limitation, the present invention relates to an illuminated bicycle helmet having a plurality of light emitting diodes activated via a motion detecting switch.

2. Background

Generally speaking, illuminated protective helmets, i.e. bicycle helmets and the like, are well known in the art. Properly crafted, such helmets may provide an added measure of safety through enticing the wearer to wear the helmet. Further, the helmets may be worn simply because such helmets can provide an expression of the individualism of the particular wearer. One often finds the illumination of such helmets integrated with the overall graphical presentation on the exterior of the helmet to complement the helmet's particular style.

A number of lighting schemes have been used to illuminate helmets such as, for example, incandescent lights, electroluminescent lights, and light emitting diodes ("LEDs" or "LED lamps"). Each lighting scheme has its own set of advantages and disadvantages. For example, incandescent bulbs are relatively inefficient and typically enclosed in glass which can be hazardous if broken. On the other hand, incandescent bulbs typically have a wide viewing angle and are relatively inexpensive. Electroluminescent devices are viewable over wide angles and tend to be more efficient than incandescent bulbs but, unfortunately, require a relatively high AC voltage for operation which complicates their use in battery operated environments. Electroluminescent panels tend to be relatively expensive.

LED lamps have a number of attributes which make them particularly attractive for use on a helmet. LEDs are relatively inexpensive as compared to electro-luminescent panels, relatively efficient as compared to incandescent lighting, and especially well suited to being driven by solid state electronics. While LEDs have a relatively narrow viewing angle, at least in comparison with incandescent and electroluminescent lighting elements, placement of the LEDs relative to the exterior of the helmet can, to a large degree, overcome this disadvantage. The vivid colors produced by LED lamps and their suitability for use with electronic controls make LEDs particularly well suited to producing aesthetic effects.

Another consideration in a lighted helmet, regardless of the lighting scheme employed, is maximizing battery life. While lamp brightness and efficiency are perhaps the most important factors, there are other factors which significantly impact battery life. For example, batteries may be consumed through inadvertent failure to turn off the lights when the helmet is not in use. Further, operating the lights at one hundred percent duty cycle, when unnecessary, will adversely effect battery life.

Other considerations in a lighted helmet include: wire routing between lamps; battery placement; and, above all, not comprising the safety aspects of the helmet by adding the illumination system.

SUMMARY OF THE INVENTION

The present invention satisfies the needs and alleviates the problems and shortcomings indicated above. In one aspect, the present invention provides lighted headgear, such as a bicycle helmet, including: a protective layer formed from an impact absorbing material; an outer shell covering a portion of said protective layer, having a plurality of translucent windows therein; a plurality of lamps positioned on the exterior surface of the protective layer and covered by the outer shell such that each lamp can project light through a translucent window; and a power source for supplying power to the lamps.

In another aspect, the present invention provides a lighted bicycle helmet which includes a motion activated switch for automatically connecting the power source to the lamps upon movement of the helmet. Upon movement of the helmet, electronic circuitry is activated which flashes LED lamps located on the helmet in a predetermined fashion. When the helmet is on the head of a rider, the motion activated switch will retrigger operation of the lamps in virtually a continuous manner. Once the helmet becomes stationary, the active sequence will complete and operation of the LED lamps will cease until the helmet is again put into operation.

Further objects, features and advantages of the present invention will be apparent to those skilled in the art upon examining the accompanying drawings and upon reading the following detailed description of the preferred embodiments.

DETAILED DESCRIPTION OF THE PREFERRED EMBODIMENT

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation.

Figure 7:
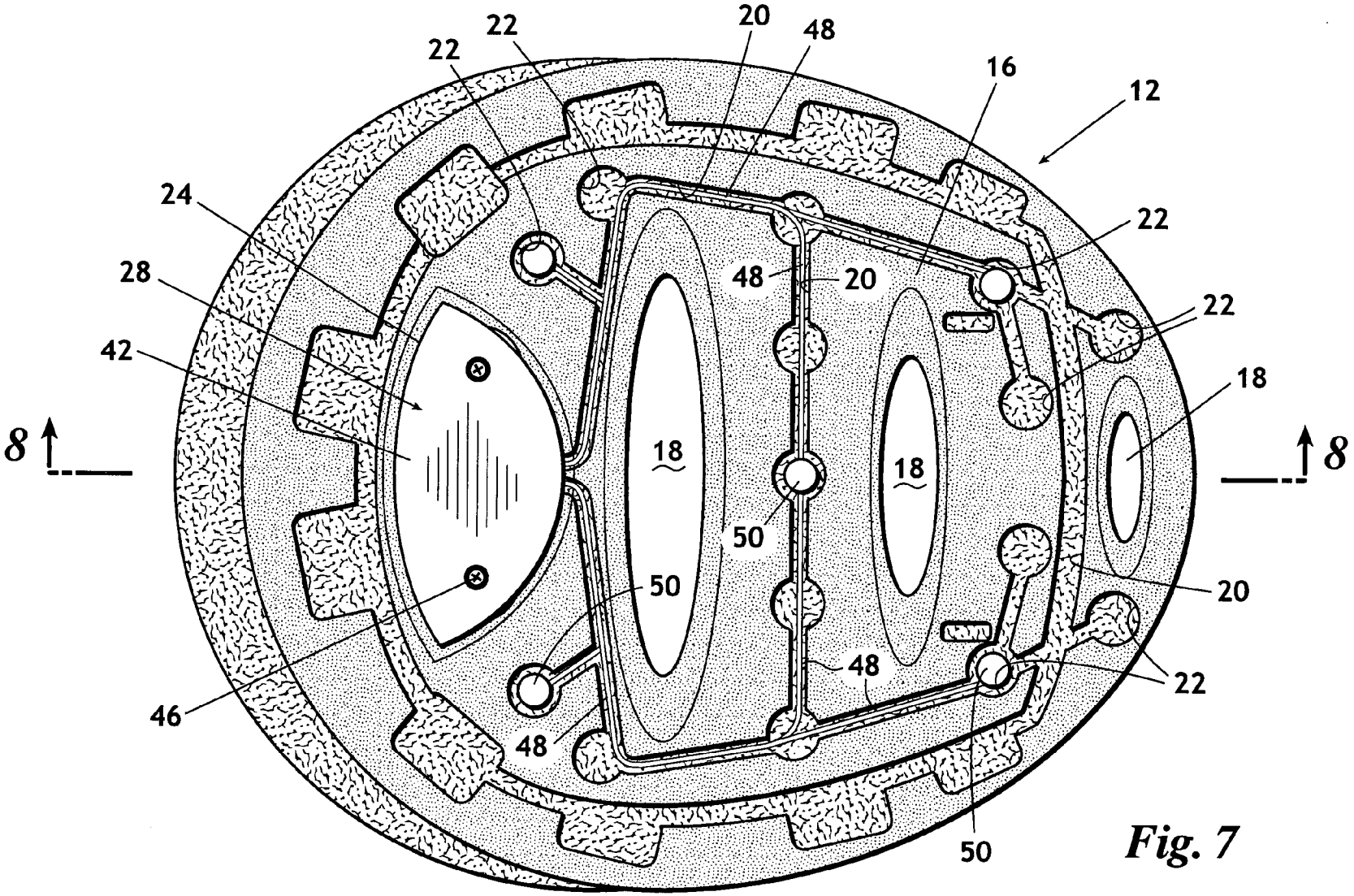
FIG. 7 is a top view of the protective shell of FIG. 1, shown with the outer shell removed.

Referring to FIGS. 1–8, wherein like reference numerals indicate the same parts throughout the several views, a lighted helmet 10 is shown. Lighted helmet 10 includes a protective shell 12 (FIGS. 1, 7, and 8) that defines an inside surface 14 (FIG. 8), an outside surface 16 (FIGS. 7 and 8), and a plurality of vents 18. As best seen in FIG. 7, the outside surface 16 has a plurality of channels 20 formed therein. Channels 20 communicate with recessed areas 22. Outer surface 16 further defines a housing cavity 24.

Anchor members 26 are located on an inside surface 14 of protective shell 12. A housing assembly 28 is located in the housing cavity 24. In another embodiment, anchor members 26 may be eliminated and the housing assembly 28 secured, e.g., glued within housing cavity 24. Housing assembly 28 includes a housing base 30. Housing base 30 defines a receptacle 32 and a flange 34. Housing base 30 is preferably comprised of an injection moldable material, such as polyethylene or other suitable material. A circuit board 36 (FIGS. 3 and 8) is located within receptacle 32. Circuit board 36 preferably controls programmed operation of the helmet lighting as discussed hereinbelow.

A battery floor 38 (FIG. 3) is located proximate circuit board 36. Batteries 40 are positioned on battery floor 38 to provide power to circuit board 36. Housing lid 42 is provided for enclosing a top 44 of receptacle 32. Preferably, attachment members such as screws 46 are provided for securing housing lid 42 to housing base 30. Housing lid 42 is preferably formed from an injection moldable material.

A plurality of wires 48 are in communication with circuit board 36. Wires 48 extend from receptacle 32. Each of the plurality of wires 48 are preferably located in one of channels 20. The plurality of wires 48 allow for flexibility in light placement since each of wires 48 may be located in a desired channel 20 for forming a desired pattern of lights.

A plurality of light emitting diode ("LED") lamps 50 are provided. Preferably, each LED lamp 50 is in communication with one of a plurality of wires 48. Each of the lamps 50 are located in one of recessed areas 22 and preferably do not protrude above the outside surface 16 of the protective shell 12.

Outer shell 52 (FIGS. 1 and 8) engages outer surface 16 of protective shell 12. Outer shell 52 is preferably made of a thermoformed plastic material, i.e. PVC, or the like, however other suitable materials or manufacturing processes may be used. Outer shell 52 has vent openings 54 that correspond to vents 18 in protective shell 12. Outer shell 52 has a plurality of protrusions 56. Each of protrusions 56 is preferably elliptical or football shaped and has a longitudinal axis 58 that is aligned with a front to back axis of the helmet 10. Each protrusion 56 preferably corresponds to a recessed area 22 for transmitting light from each of the plurality of LED lamps 50 located therein.

Figure 2:
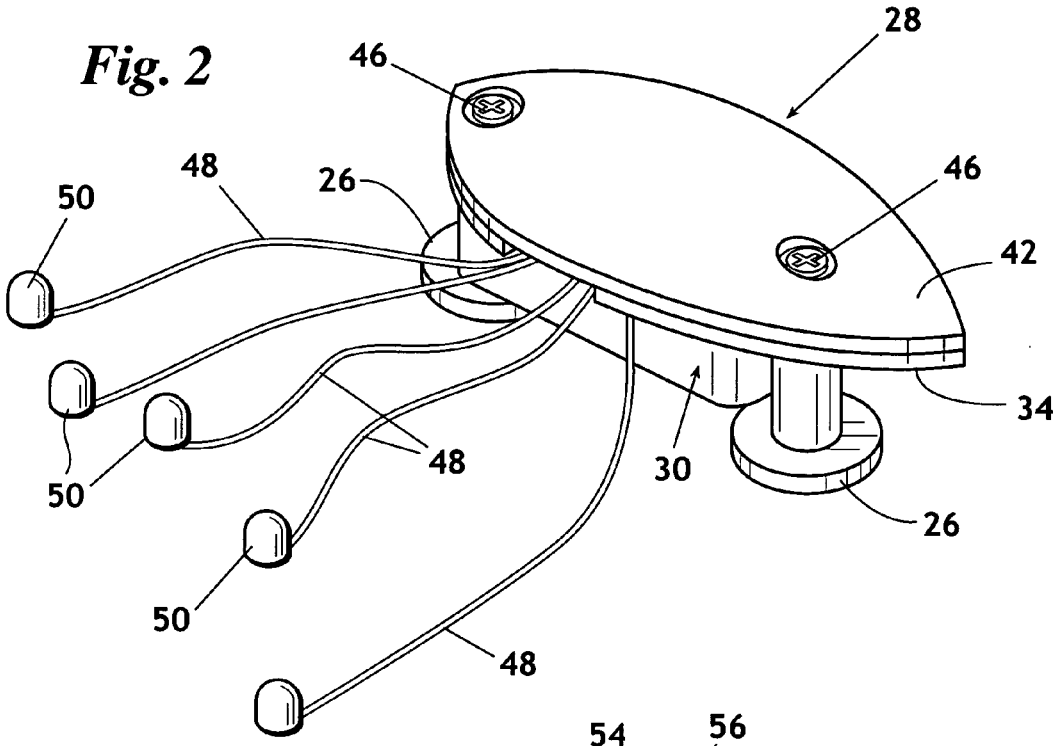
FIG. 2 is a perspective view of a housing assembly of the invention with a plurality of wires and LED lamps in communication therewith.
Figure 1:
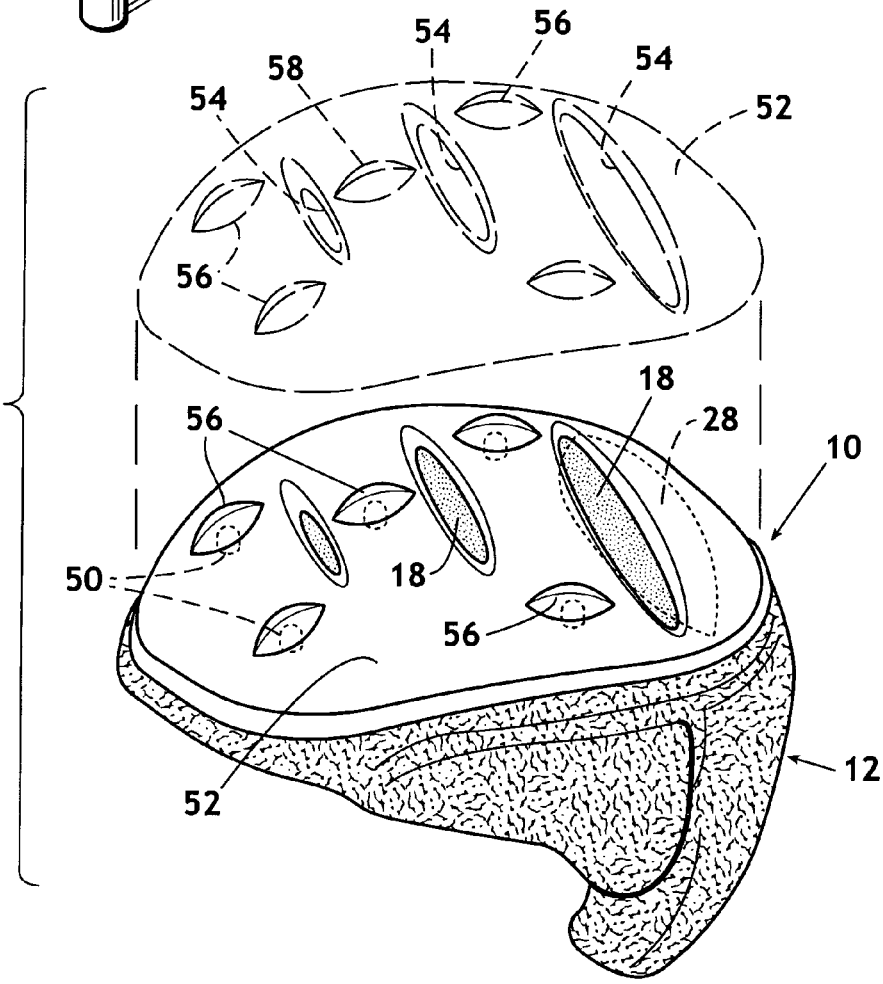
FIG. 1 is a perspective view of a helmet showing an outer shell affixed to a protective shell and showing the outer shell removed from the protective shell with phantom lines.
Figure 3:
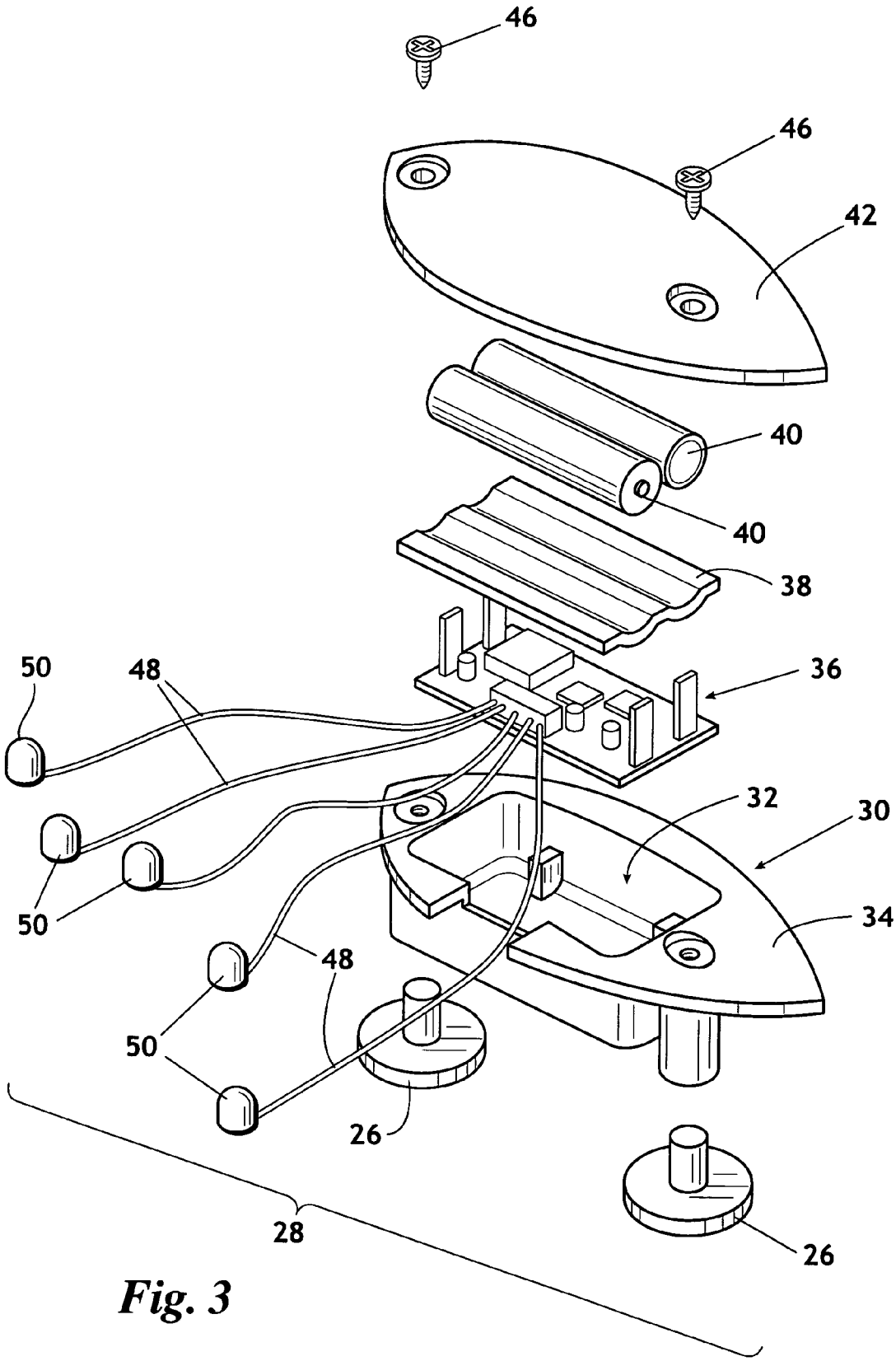
FIG. 3 is an exploded perspective view of the housing assembly of FIG. 2.
Figure 4:
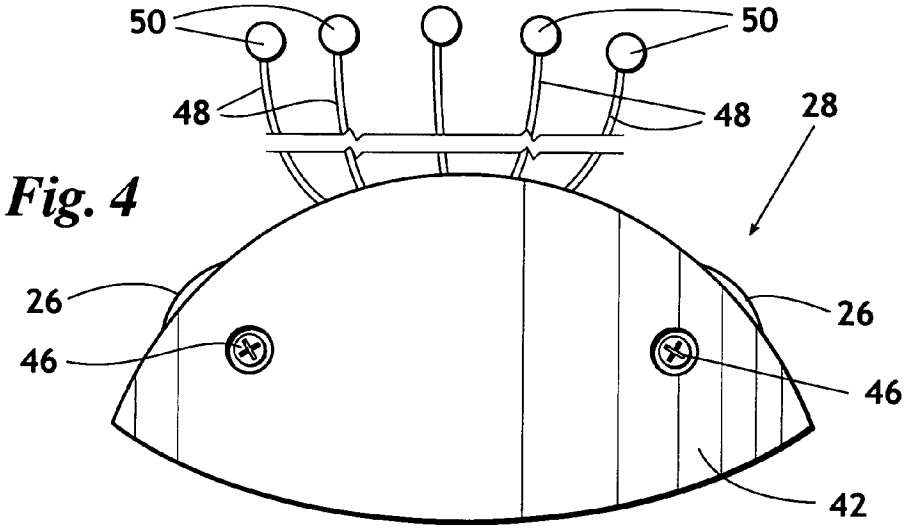
FIG. 4 is a top view of the housing assembly of FIG. 2.
Figure 5:
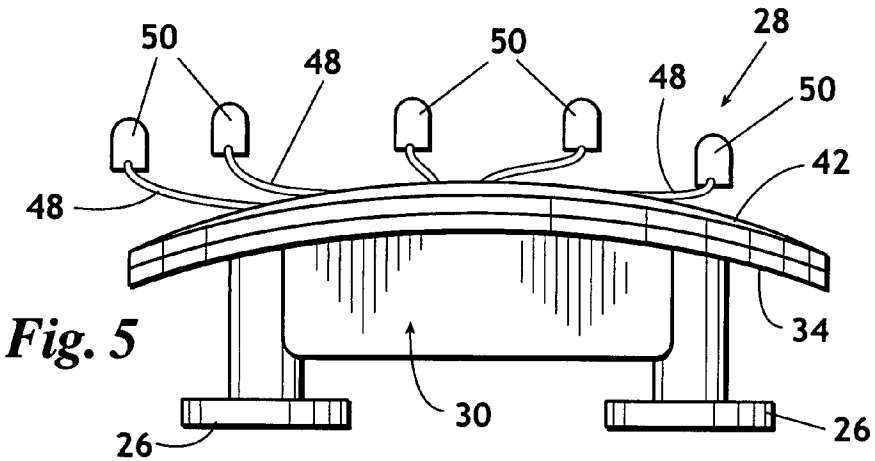
FIG. 5 is a front view of the housing assembly of FIG. 2.
Figure 6:
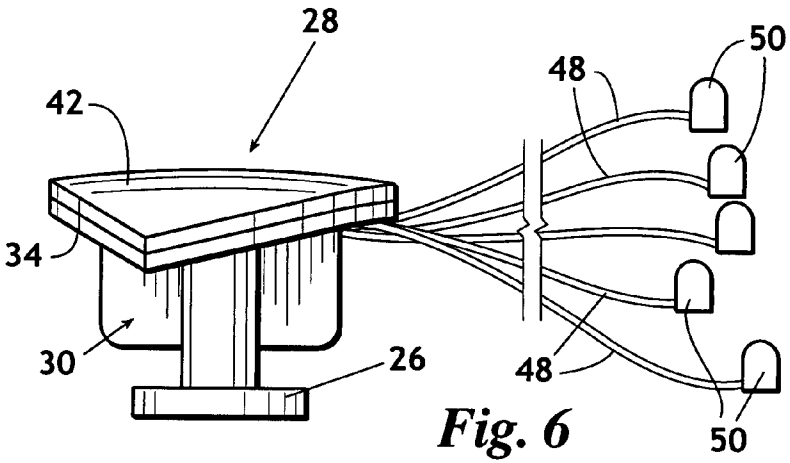
FIG. 6 is a side view of the housing assembly of FIG. 2.

In one embodiment, shown in FIG. 1, the housing assembly 28 is hidden beneath the outer shell 52. In a second embodiment, shown in FIG. 8, the housing assembly 28 is visible and accessible through an opening 62 formed in the outer shell 52.

Figure 9:
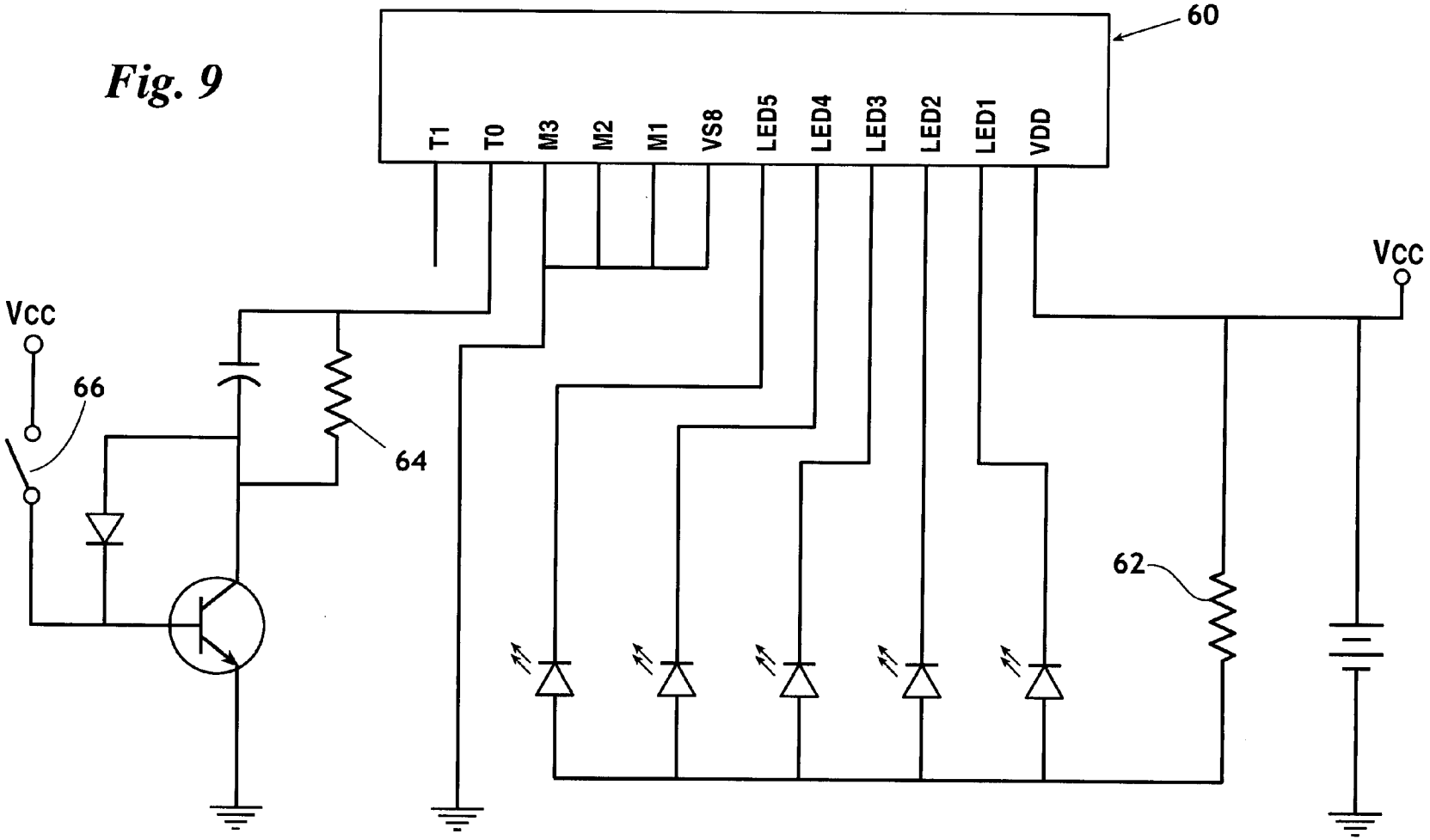
FIG. 9 is a circuit diagram of a preferred circuit for flashing the LED lamps.

Turning to FIG. 9, circuit 36 includes: flasher module 60; LED ballasting resistors 62; and timing resistor 64. Flasher module 60 is preferably an integrated circuit which is programmed to flash LED lamps in a predetermined fashion, whether sequential, random, or a combination thereof. LED flasher modules are well known in the art and are, generally, available as an off-the-shelf component. The rate at which the LED lamps 50 are flashed is determined by a timing component, i.e. timing resistor 64. As will be apparent to those skilled in the art, in lieu of module 60, a microcontroller, along with an appropriate program, could alternatively be used to control LEDs 50, or even discrete logic. LEDs 50, batteries 40, and switch 66 may be located either on board 36 or remotely from board 36 and connected with wires.

In a preferred embodiment, module 60 is programmed to cycle through various programs of LED flashing upon the cycling of switch 66. After a program is complete, preferably the LEDs 50 are extinguished until the next cycling of switch 66. By way of example and not limitation, upon the first actuation of switch 66, all LEDs 50 might be illuminated. Upon a subsequent actuation of switch 66, each LED 50 may be individually illuminated in a sequential manner. Upon another subsequent actuation of switch 66, LEDs 50 may be individually flashed in a random manner for a period of time. Any number of programmed events may be cycled until the end of the program is reached whereupon the process repeats, beginning with all LEDs 50 on.

If switch 66 is actuated by motion, as a wearer moves around with the helmet 10 (FIG. 1), switch 66 will be repeatedly actuated such that, as each program completes, the next LED program is quickly and automatically initiated by the wearer's movement. When helmet 10 is removed and placed in a stationary position, the current LED program will complete and then LED lamps 50 will be shut off. In this way, batteries will only be consumed while helmet 10 is actually being used. Once helmet 10 is stored, it cannot be left on inadvertently to run the batteries down.

Figure 10:
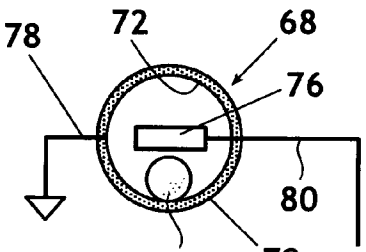
FIG. 10 is a motion detecting switch for use with the circuit of FIG. 9.
Figure 8:
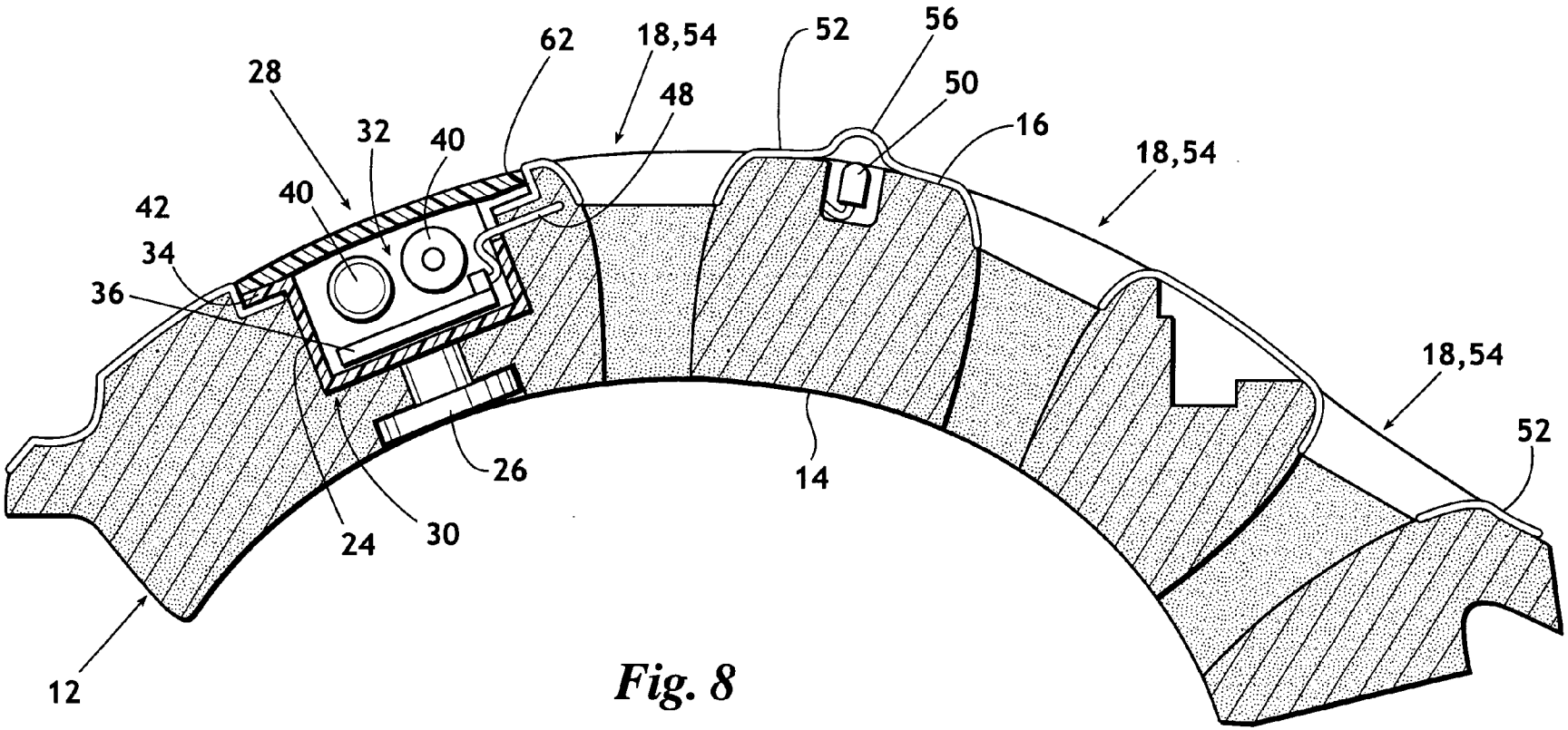
FIG. 8 is a cross-section view of FIG. 7, taken along line 8—8 of FIG. 7.

One example of a suitable motion detecting switch 66 is switch 68 shown in FIG. 10. Switch 68 includes a spherical shell 70 having a conductive inner surface 72, a conductive ball 74, and a contact member 76. As ball 74 rolls around inside sphere 70 as a result of motion, ball 74 will periodically come into contact with contact member 76 to complete the circuit between terminal 78 and terminal 80.

Figure 11:
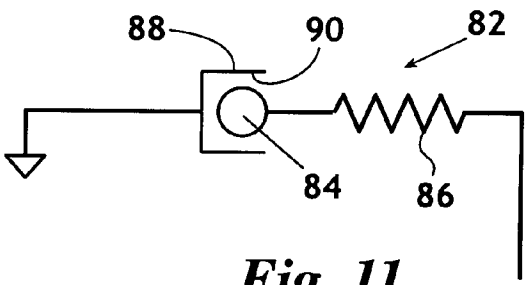
FIG. 11 is an alternative motion detecting switch for use with the circuit of FIG. 9.

Another example of a suitable motion detecting switch 66 is switch 82 shown in FIG. 11. Switch 82 includes a conductive weight 84 suspended from a spring 86 within housing 88 which has a conductive inner surface 90. As weight 84 moves around in response to motion, it periodically contacts surface 90 to complete the circuit between terminals 92 and 94.

Numerous other possibilities are equally well suited to trigger module 60. By way of example and not limitation such possibilities include: a mercury switch; a Piezo-type accelerometer; a pendulum-type switch, or even a conventional accelerometer in combination with circuitry to produce a binary output indicative of motion of the helmet. The important aspect of such motion detecting switches being to provide occasional transitions in response to small accelerations, preferably at least in a front to back direction, which invariably occur when helmet 10 is in motion.

Thus, once a user dons helmet 10, even small movements of the user's head result in forces that periodically trigger the motion detecting switch 66. Operation of the motion detecting switch, in turn, triggers module 60 which flashes LED lamps 50 through a predetermined program. Upon completion of the program, a subsequent operation of switch 66 will trigger the next program of module 60, and so the process continues until helmet 10 is placed in a stationary position.

In use, LED lamps 50 project light through protrusions 56 in outer shell 52. Protrusions 56 are clear, or otherwise translucent, so that light emitted from LED lamps 50 illuminate protrusions 56. Protrusions 56 are preferably oblong and arranged in a aerodynamic orientation. Lamps 50 preferably do not extend above the outside surface 16 of protective shell 12 so that a lamp 50 will not be forced inwardly upon impact of the helmet 10 against a surface. The appearance of helmet 10 may be customized by locating LED lamps 50 in selected channels 20 or recessed areas 22 of protective shell 12 as desired.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A lighted headgear comprising:

a protective shell defining an inside surface and an outside surface;

an outer shell in communication with said outside surface of said protective shell;

a plurality of lamps adapted to emit light through said outer shell;

a power supply in electrical communication with said plurality of lamps to provide power for the operation of said plurality of lamps;

a motion detecting switch in communication with said lamps such that, upon movement of said motion detecting switch, electrical power is supplied to at least one lamp of said plurality of lamps for a predetermined period of time; and wherein said outer shell is provided with a plurality of translucent windows through which said lamps emit light;

said translucent windows comprise protrusions wherein said protrusions are elliptical having a longitudinal axis aligned with a front to back axis of said protective shell.

2. The headgear according to claim 1 further comprising a flasher module which receives power from said power supply and selectively provides power to individual lamps of said plurality of lamps, said flasher module having a plurality of programs for flashing said plurality of lamps, wherein said predetermined period of time is the length of time of a particular program.

3. The headgear according to claim 1 wherein said power supply comprises a battery.

4. The headgear according to claim 1 wherein each lamp of said plurality of lamps is a light emitting diode.

5. The headgear according to claim 2 wherein:

a first program of said plurality of programs turns on all of the lamps of said plurality of lamps for said predetermined period of time.

6. The headgear according to claim 5 wherein said predetermined period of a time is a first predetermined period of time and a second program of said plurality of programs flashes individual lamps of said plurality of lamps in a random manner for a second predetermined period of time.

7. A lighted headgear comprising:

a protective shell defining an inside surface and an outside surface;

a plurality of lamps emitting light from said outside surface;

a power supply in electrical communication with said plurality of lamps to provide power for the operation of said plurality of lamps;

a motion detecting switch in communication with said lamps such that, upon movement of said motion detecting switch, electrical power is supplied to at least one lamp of said plurality of lamps for a predetermined period of time; and wherein said motion detecting switch comprises:

a housing having an interior and a conductive inner surface connected to a first terminal;

an electrical contact extending into said interior of said housing, said electrical contact connected to a second terminal; and a conductive ball housed in said housing such that upon sufficient movement of said motion detecting switch, said ball will roll into simultaneous contact with said conductive inner surface and said contact thereby completing an electrical circuit between said first terminal and said second terminal.

8. A lighted headgear comprising:

a protective shell defining an inside surface and an outside surface;

a plurality of lamps emitting light from said outside surface;

a power supply in electrical communication with said plurality of lamps to provide power for the operation of said plurality of lamps;

a motion detecting switch in communication with said lamps such that, upon movement of said motion detecting switch, electrical power is supplied to at least one lamp of said plurality of lamps for a predetermined period of time; and wherein said motion detecting switch comprises:

a housing having a conductive inner surface connected to a first terminal;

a spring;

a conductive weight suspended from said spring and projecting into said housing, said conductive weight connected to a second terminal, wherein acceleration of the motion detecting switch will cause a deflection of said spring such that said conductive weight contacts said conductive inner surface to complete an electrical circuit between said first terminal and said second terminal.

* * * * *